United States Patent [19]

Urdanoff

[11] 4,288,324

[45] Sep. 8, 1981

[54] SKIMMING APPARATUS

[76] Inventor: Howard D. Urdanoff, P.O. Box 3152, Bethlehem, Pa. 18017

[21] Appl. No.: 87,745

[22] Filed: Oct. 24, 1979

Related U.S. Application Data

[63] Continuation-in-part of Ser. No. 938,644, Aug. 31, 1978, abandoned.

[51] Int. Cl.[3] ..... E02B 15/04

[52] U.S. Cl. ..... 210/242.1; 210/355

[58] Field of Search ..... 210/83, 242 R, 242 S, 210/DIG. 25, 158, 159, 355

[56] References Cited

U.S. PATENT DOCUMENTS

| | | | |
|---|---|---|---|
| 2,330,508 | 9/1943 | McColl | 210/242 |
| 2,608,300 | 8/1952 | Small | 210/242 |
| 2,661,094 | 12/1953 | Stewart | 210/242 |
| 3,682,316 | 8/1972 | Waran | 210/DIG. 25 |
| 3,688,909 | 9/1972 | Titus | 210/DIG. 25 |
| 3,849,308 | 11/1974 | Westerman | 210/242 |
| 3,883,433 | 5/1975 | March et al. | 210/242 S |
| 3,935,103 | 1/1976 | Disque et al. | 210/DIG. 25 |
| 3,959,136 | 5/1976 | Ayers et al. | 210/83 |
| 3,970,556 | 7/1976 | Gore | 210/242 S |
| 4,010,103 | 3/1977 | Morgan | 210/DIG. 25 |
| 4,085,049 | 4/1978 | Hartwick | 210/242 S |
| 4,153,557 | 5/1979 | Hori | 210/158 |

OTHER PUBLICATIONS

Modern Application News, p. 2, Apr. 1978, Nelson Building–Highland Park, Ill., 60035

*Primary Examiner*—Theodore A. Granger
*Attorney, Agent, or Firm*—Michael J. Murphy

[57] ABSTRACT

A skimming system for removing a floating layer from a body of liquid which includes a skimmer for semi-immersion in the liquid having an irregularly shaped hollow interior compartment supported for self-adjustable tilting movement from a recumbent position generally parallel with the reservoir surface to an inclined position admitting the floating layer to the compartment. A self-cleaning assembly operable in response to skimmer movement protects the skimmer inlet from debris entry and includes cleaning fingers cantilevered out from the skimmer over the opening protruding between a grid of upright blocking baffles.

10 Claims, 8 Drawing Figures

Fig. 2.
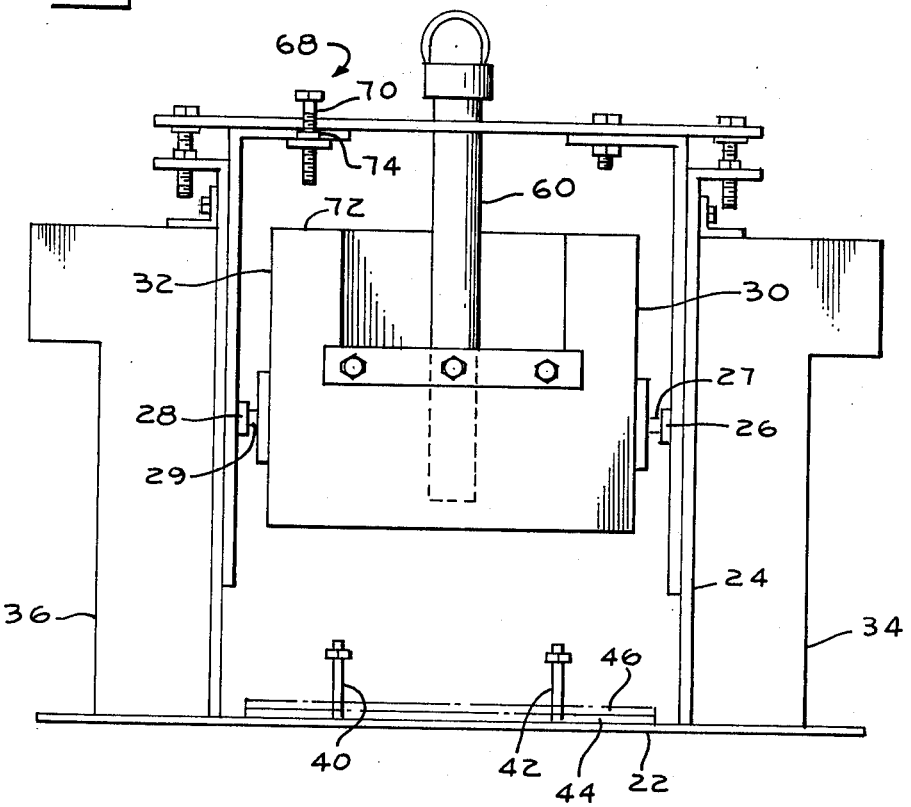
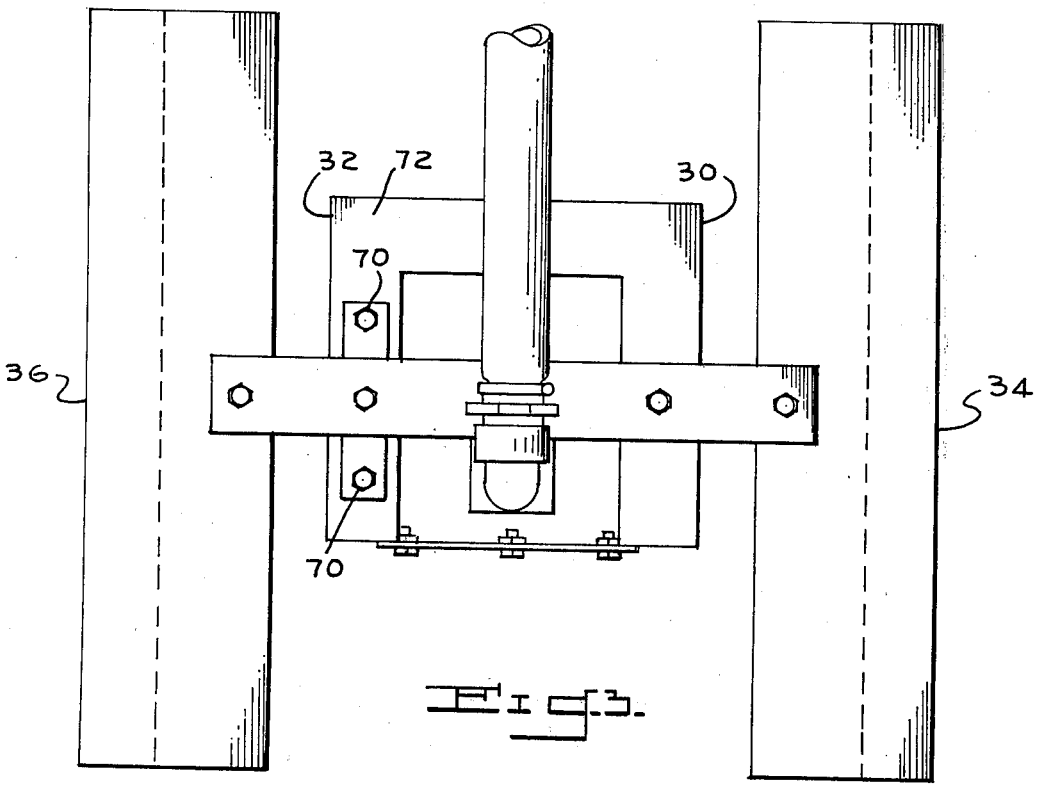
Fig. 3.

SKIMMING APPARATUS

BACKGROUND OF THE INVENTION

This application is a continuation-in-part of copending application Ser. No. 938,644, filed Aug. 31, 1978, now abandoned.

This invention relates to a skimming system for removing a floating layer from a body of liquid and more particularly to an improved, self-actuating skimmer which automatically removes such layer as a result of its special configuration.

Systems for removing floating from heavier layers of liquids as well as settling systems for removing solids from processing liquids prior to reuse are widely known. Typical of such latter systems is that disclosed in U.S. Pat. No. 3,456,798 for use in clarifying coolants used in operating machine tool equipment. Though functional, tramp oil contaminants present special removal problems in such systems and unless removed both the useful life and efficiency of the process liquid are adversely affected. Such fraction is lighter than the usually water soluble oil or synthetic solutions being clarified and therefore floats on and resists settling removal from such settling reservoirs.

SUMMARY OF THE INVENTION

Now, however, a system has been developed which is specifically designed to effectively remove any lightweight floating body of liquid and specifically a floating tramp oil layer from either existing or newly installed clarifying reservoirs such as in sumps, pits, lagoons and the like.

Accordingly, it is a principal object of this invention to provide a skimming system for continuously removing a top floating contaminant layer from a body of liquid, for example a contaminated coolant layer from a settling reservoir.

A specific object of this invention is to provide such a system which separates the skimmed phase so removed into heavy and light fractions and returns the heavy phase to the system for continued use without interfering with the ongoing operation of the basic system in which the apparatus is installed.

A particular object of this invention is to provide an improved skimmer design which in operation is automatically self-actuatable and self-cleaning as a result of its special configuration.

Yet another object of this invention is to provide a self-cleaning attachment for a tiltable skimmer responsive to the skimmer movement for protecting the skimmer from entry of clogging debris.

Other objects of this invention will in part be obvious and will in part appear from the following description and claims.

These and other objects are accomplished by providing a liquid skimmer comprising a housing forming an inner operating compartment tiltably responsive to a liquid level therein having a cross section when in balanced equilibrium condition circumscribing a substantially quadrantal section inter-communicating with a substantially right triangular section.

BRIEF DESCRIPTION OF THE DRAWINGS

In describing the overall invention, reference will be made to the accompanying drawings wherein:

FIGS. 2 and 3 are front and top views respectively of the skimmer component in the system of FIG. 1;

DETAILED DESCRIPTION OF THE ILLUSTRATED EMBODIMENT

Figure 1:
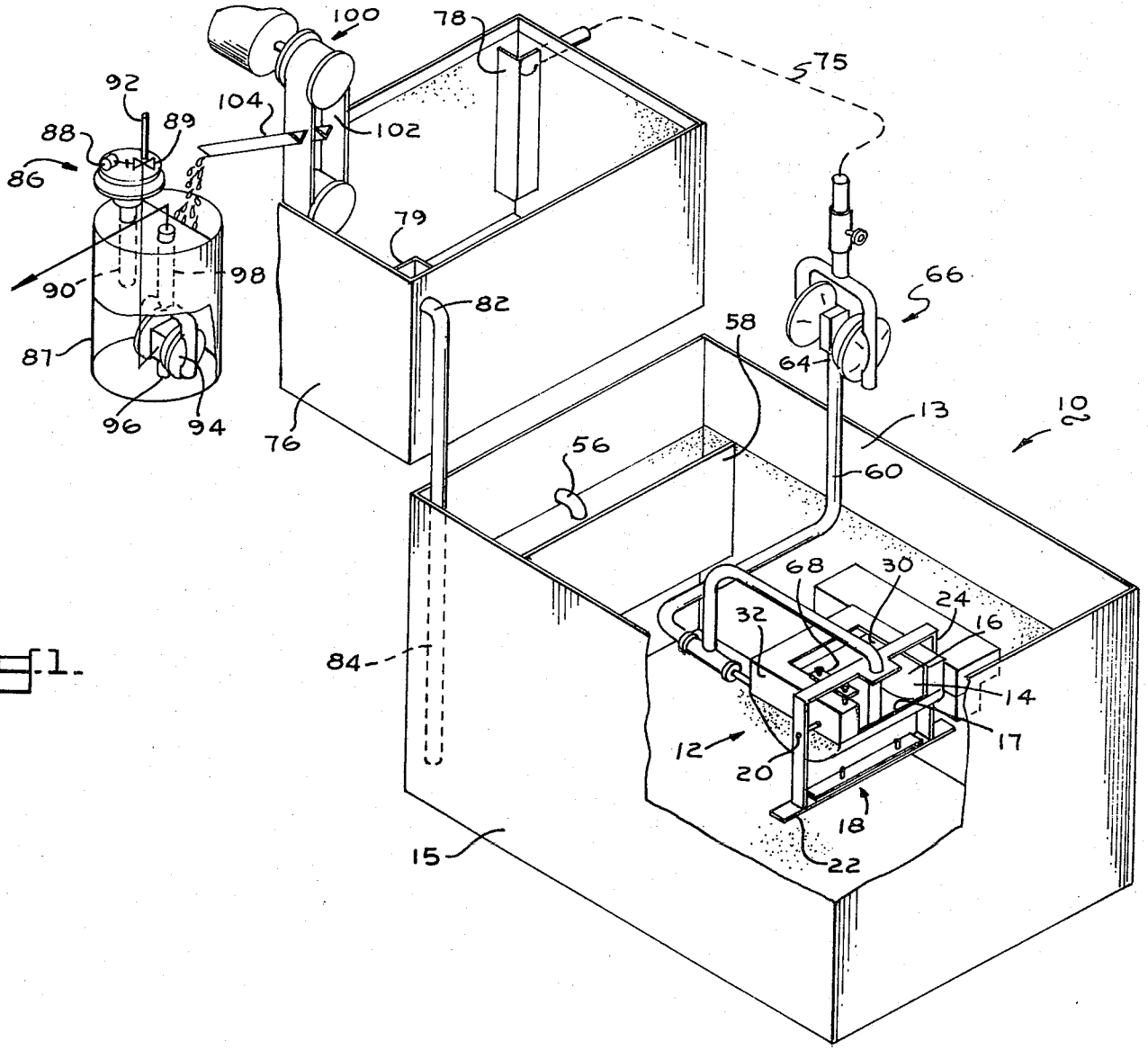
FIG. 1 is a schematic perspective view of a skimming system embodying the present invention.
Figure 6:
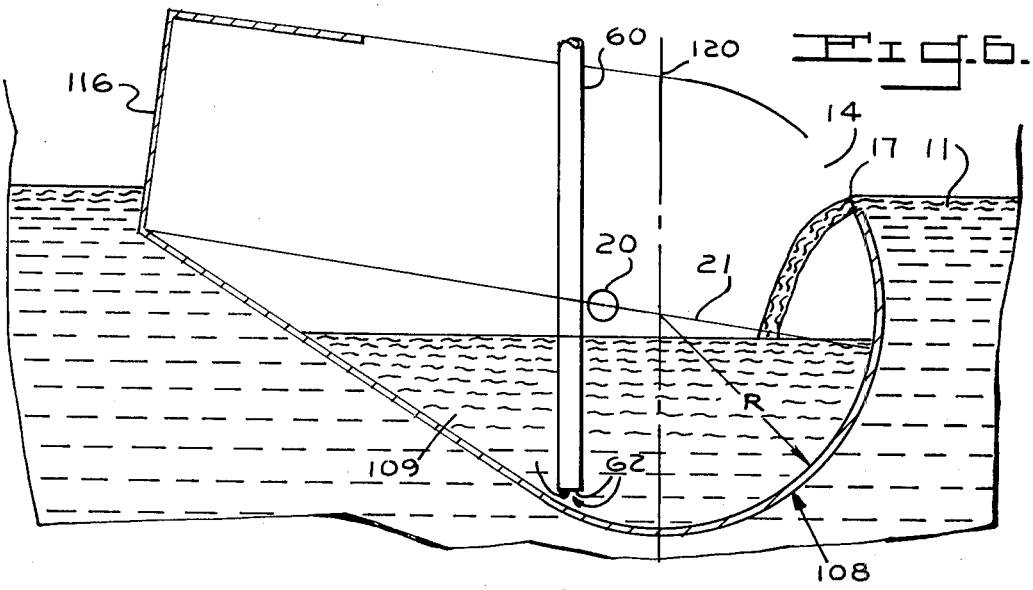
FIGS. 4, 5 and 6 are schematic showings of three typical operating positions of the skimmer illustrated in FIGS. 1–3, and FIGS. 7 and 8 are front and side elevational views respectively of a skimming system which includes a cleaning assembly embodying the present invention.
Figure 5:
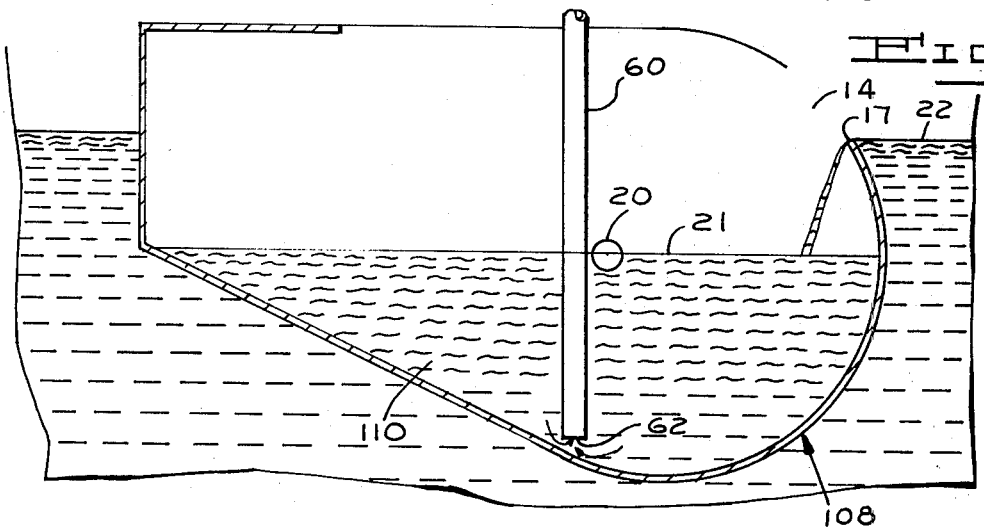
Figure 4:
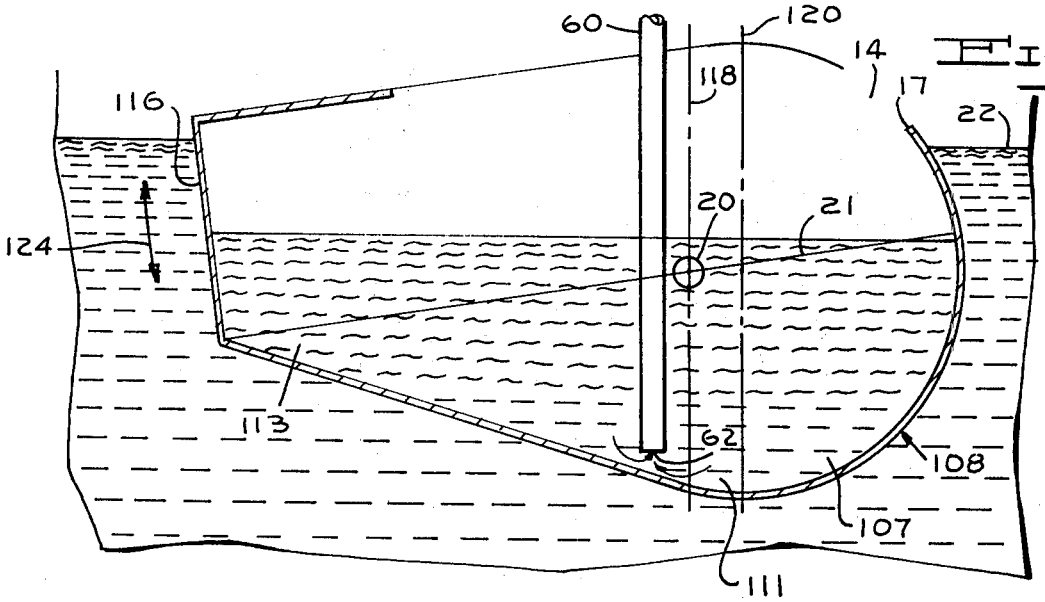

Referring now to the drawings, a skimming system collectively identified as 10 is illustrated in FIG. 1 for removing a floating contaminant layer 11 (FIG. 6) from a liquid reservoir 13 contained within rectangular tank 15. Skimming system 10 comprises skimmer 12 for semi-immersion in liquid reservoir 13 within tank 15 having a horizontally long inlet port or opening 14 extending across substantially the entire front of skimmer 12 for floating layer 11 and, in a broad sense, an irregularly shaped hollow interior compartment 16 approximating in the illustrated embodiment a truncated ovoidal shape in total cross section and which is to be further described. As illustrated in FIGS. 4–6, compartment 16 in operation is preferably devoid of any buoyant members therein. Means in the form of a carrier framework 18, which may differ in detail from that shown, journally supports skimmer 12 for tilting movement about horizontal axis 20 from the recumbent position of FIG. 5 in which it lies generally parallel to the surface 22 of the liquid reservoir 13 to the inclined positions of FIGS. 4 and 6 at which lip 17 of opening 14 is above or below the liquid surface 22 in reservoir 13. Framework 18 (FIGS. 2 and 3) comprises rigid horizontal 22 and vertical 24 struts carrying bearings 26, 28 journally supporting stub shafts 27, 29 rigidly connected to sides 30, 32 of skimmer 12 for pivotal movement of same. Skimmer 12 is preferably mounted for buoyant support within reservoir 13 via floats 34, 36 (one being removed for clarity in FIG. 1) secured to uprights 24, 25. Alternatively skimmer 12 may be rigidly supported from the sides of tank 15 for pivotal movement, for example when the level of the reservoir as supplied from one or more upstream sources is maintained relatively constant. Pins 40, 42 projecting from strut 22 may be provided to removably accomodate one or more bar weights 44, 46 having through holes for pins 40, 42, thus providing for adjustably setting the extent to which float-mounted skimmer 12 rides vertically in the reservoir.

Means in the form of inlet conduit 56 having an outlet preferably below the liquid level of reservoir 13 to promote quiescent conditions therein is in fluid communication with an upstream source supplying contaminated liquid to reservoir 13 in tank 15. The inlet to tank 15 is also preferably located behind crosswise baffle 58 and directed downwardly to minimize any tendency of the inlet liquid to short circuit.

Means in the form of a conduit 60 which is preferably flexible is in fluid communication with the important operating compartment 16 within skimmer 12 and with skimming pump 66 in that it has inlet opening 62 (FIGS. 4–6) within such compartment and outlet opening 64 connected to the suction of pump 66. Such means associated with the skimmer removes contaminant from the hollow interior compartment 16 thereof in a matter to be further described.

Adjustable stop means 68 (FIGS. 1 and 2) associated with the skimmer 12 and support framework 18 are importantly provided for delimiting tilting movement of skimmer 12. More specifically, stop means 68 includes threaded member 70, 71 vertically adjustable with respect to the skimmer, for example, upper side surface 72 thereof, and held in fixed position e.g. by nut 74. Thus, when surface 72 abuts against the lower end of threaded bolts 70, 71 further tilting movement of skimmer 12 is positively prevented.

Scavage reservoir 76 (FIG. 1), smaller in size and positioned downstream of settling reservoir 15, is preferably provided for receiving liquid from skimming pump 66 through pump discharge line 75. The liquid inlet to scavage reservoir 76 may be situated behind vertical baffle 78 situated in one corner of such reservoir 76. A similar baffle 79 may be mounted in the opposite corner of reservoir 76 behind which there is the inlet opening of return conduit 82 through which coolant from scavage reservoir 76 is returned to system reservoir 13. Entry to the latter may be via downpipe 84 behind baffle 58 permitting the liquid to enter below the top level as shown.

A belt skimmer 100 is provided within scavage reservoir 76 and consists of an endless metal belt 102 having an affinity for oil being concentrated in reservoir 76 which moves substantially vertically up through reservoir 76 removing the top, floating oil level therefrom. Both sides of belt 102 continuously physically rub against tilted scraper 104 to remove the oil therefrom and discharge it by gravity into sludge container 87 for handling by sludge system 86 now to be described.

Sludge system 86 comprises a sludge container 87 mounted either separate or supported from scavage reservoir 76, and self-contained level controller 88 actuated when the level in container 87 rises through stand pipe 90 above a predetermined amount. Actuation of valve 89 associated with controller 88 permits compressed air from header 92 to flow to pneumatically operated sludge pump 94 which has an inlet 96 in communication with the reservoir within container 87 and a discharge pipe 98 in communication with a downstream waste collection area.

Various high and low liquid level alarm systems, flow switches, level controllers and the like, not shown, on makeup supply lines and the like may be used in the system and scavage reservoirs in a conventional manner well known to those skilled in the art and not requiring further description here.

Referring now to FIGS. 4–6, wherein the operation of skimmer 12 and its irregular shape in cross section is further depicted, such shape in a broad sense comprises arcuate and triangular cross sectional portions tiltable about axis 20. More specifically, the cross section of the irregularly shaped compartment circumscribes an operating chamber below compartment centerline 21 comprising a substantially quadrantal section 108 forming at least about one-eighth of a full circle of radius R intercommunicating when skimmer 12 is in the substantially balanced equilibrium position of FIG. 5, with a substantially right triangular section 110 of progressively decreasing cross section toward closed rear wall 116. Such right triangular section of the total operating compartment 16 below centerline 21 is shown as 109 in the tilted skimmer position of FIG. 6 and 113 in the FIG. 4 position. In actuality, in the specific embodiment of FIGS. 4–6 the portion to the right of vertical axis 118, i.e. between centerline 21 and axis 118 includes a substantially rectangular portion 111 in addition to quandrantal section 107 and the combination of such two portions, as well as relatively minor modifications of same is considered to constitute a "substantially quandrantal section" 108 as the latter terminology is used herein. Section 108 (FIG. 5), 113 and 109 (FIGS. 4 and 6) are substantially equal in cross sectional area. Pivot axis 20 of skimmer 12 lies in a vertical plane 118 through compartment in the region of the confluence of the triangular section 109, 110 and 113, and substantially quadrantal section 108, and more particularly such mounting in the illustrated embodiment is in a plane laterally displaced toward the apex of the triangular section from the plane of actual communication between quadrantal section 107 and triangular sections 109, 110 and 113.

In operation, contaminated liquid containing a light fraction such as tramp oil contaminant is supplied to system reservoir 13 from one or more upstream supply stations. The skimmer which may be portable is easily and quickly semi-immersed in the area of greatest concentration of floating contaminant layer in the reservoir. By raising or lowering the skimmer intake lip 17 by adding or removing weights 44, 46, the amount of floating contaminant (as well as the proportion of process fluid) which is removed can be tailored to meet the needs of a particular installation. Skimming pump 66 is continuously operating and via control of its pumping rate in combination with stop members 70 controls the thickness of the floating or scum layer removed by the skimmer. When the liquid level 22 in tank 15 rises above lower lip 17 of inlet opening 14 of skimmer 12 the tipped or canted condition of FIG. 6 is assumed with the uppermost floating light layer 11 overflowing into the operating compartment in the manner illustrated. As long as the upstream supply to reservoir 13 continues at a rate exceeding that at which pump 66 is emptying the skimmer, the liquid in substantially quadrantal section 108 which is greater in quantity and weight than that in substantially triangular section 109 serves as a fulcrum to automatically cause the skimmer to tilt about axis 20 and assume the FIG. 6 position to keep lip 17 immersed in floating layer 11 and insure continual flow to the interior operating compartment of the skimmer and draw-off through conduit 60. When the feed supply to reservoir 13 is substantially in balance with the draw-off rate of pump 66, skimmer 12 automatically and self-adjustably pivots counter-clockwise in the opposite direction from FIG. 6 toward the position shown in FIG. 5 thereby automatically arcuately displacing lip 17 and inlet opening 14 upwardly from the FIG. 6 position yet continuing to receive a liquid skim phase on an equilibrium basis while being drawn off at the same rate. Liquid in quadrantal portion 108 in the FIG. 5 position acts as a counterbalance against the skimmer assuming the FIG. 4 position now to be described.

When the draw-off rate through line 60 clearly esceeds the rate at which liquid is being supplied to the reservoir, the imbalanced position of FIG. 4 is automatically and self-adjustably assumed by skimmer 12 wherein the liquid in the triangular section 113 causes the skimmer to pivot counterclockwise in the direction of arrow 124 until the preset stop on framework 18 and the opposite face of the skimmer make contact to arrest further upward motion thereby clearly raising the lip 17 up above liquid level 22 and stopping flow into the operating compartment. In actual practice when the input supply to the reservoir fluctuates fairly rapidly the skimmer may rather abruptly rock up and down continuously between the FIG. 4 and FIG. 6 positions. It is in these latter FIG. 4 and FIG. 6 positions that downward and upward movement is positively delimited via stop members 70 abutting against the upper face 72 of the skimmer. The thickness of the layer being removed and the extent to which lip 17 rises out of the liquid is determined by the setting of vertically adjustable stop member 70.

Thus it can be seen that the volume of liquid in the portion of triangular cross section of the specially shaped operating compartment 16 of skimmer 12 below skimmer centerline 21 varies considerably with the level of liquid in the skimmer while that within the substantially quadrantal cross section is comparatively fairly constant. Such variability of the liquid in the triangular section results in the levering action that causes the skimmer to automatically tilt between the FIGS. 4, 5 and 6 positions against the counterbalancing force provided by the substantially constant content of the substantially quadrantal section.

As an important feature of the invention, any floating solids which may accumulate on the liquid surface in reservoir 13 in the area of the operating region of skimmer lip 17 have a finite interval while lip 17 is above the liquid surface in the FIG. 4 position during which time such solids have a chance to float away from around the skimmer opening thus helping to clear the area around lip 17 of such solids and avoiding blockage of such opening 14 and buildup inside the skimmer when it next returns to the filling positions of FIG. 5 or 6.

As previously described, the light tramp oil phase is received via pump 66 in scavage reservoir 76 for separation of the floating contaminant layer which rises to the top from the heavier valuable layer which settles to the bottom and which is returned to the system—i.e. to settling reservoir 15, for example through return line 84, and eventually from reservoir 15 back to the plant operating zone for reuse through a conventional conduit, not shown. Tramp oil is removed from scavage reservoir 76 via belt skimmer 100 and sludge system 86 to a suitable storage container or to a plant waste facility.

Thus, by settling first to the bottom of reservoir 13 while drawing off the contaminated topmost layer therefrom, the remaining fluid stays fresh and usable for a much longer time than if returned for reuse while still contaminated with the contents of the floating topmost layer. With the illustrated and preferred embodiment shown utilizing the skimmer in combination with a scavage reservoir to separate the floating layer, wide ratios (i.e. very low or very high) of floating oily waste layer to total liquid being skimmed with the skimmer can be efficiently removed from the settling reservoir without loss of the valuable heavier liquid phase which, as mentioned, is concentrated in such scavage reservoir and returned to the system.

Figure 7:
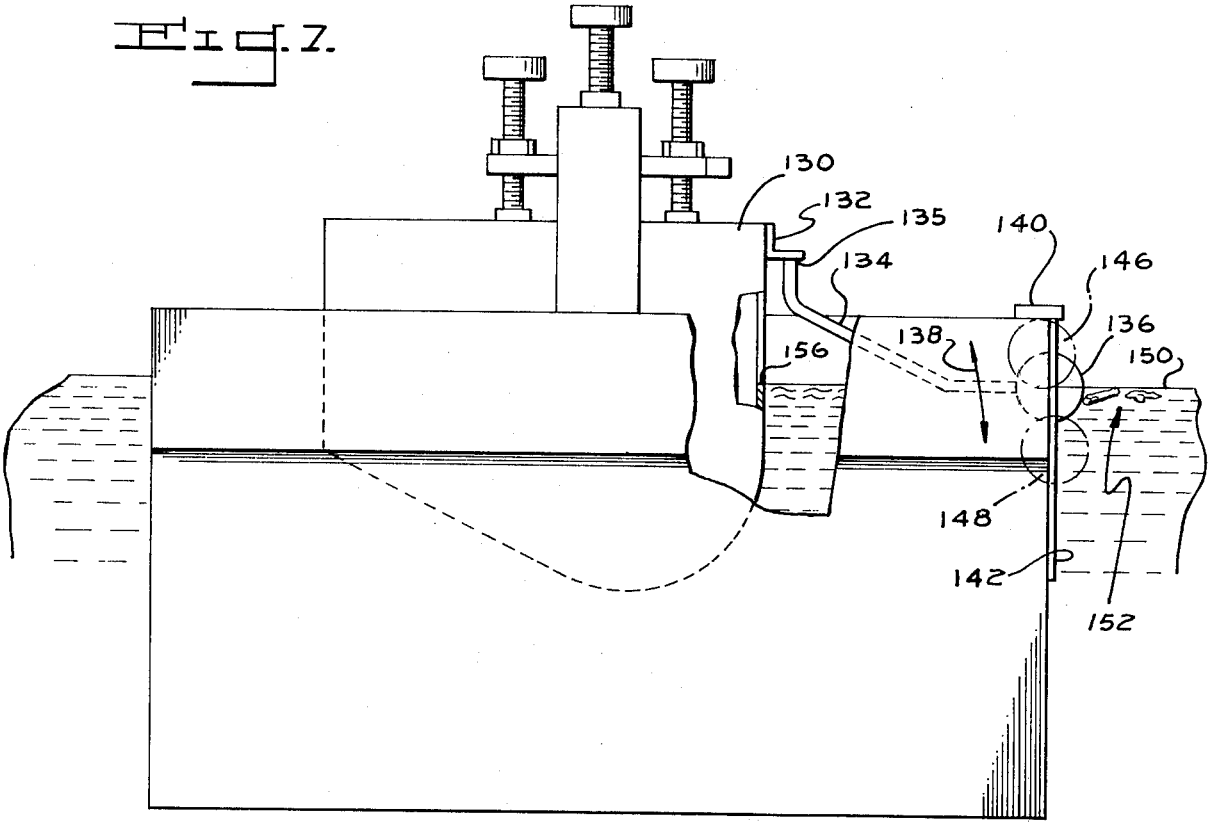
Figure 8:
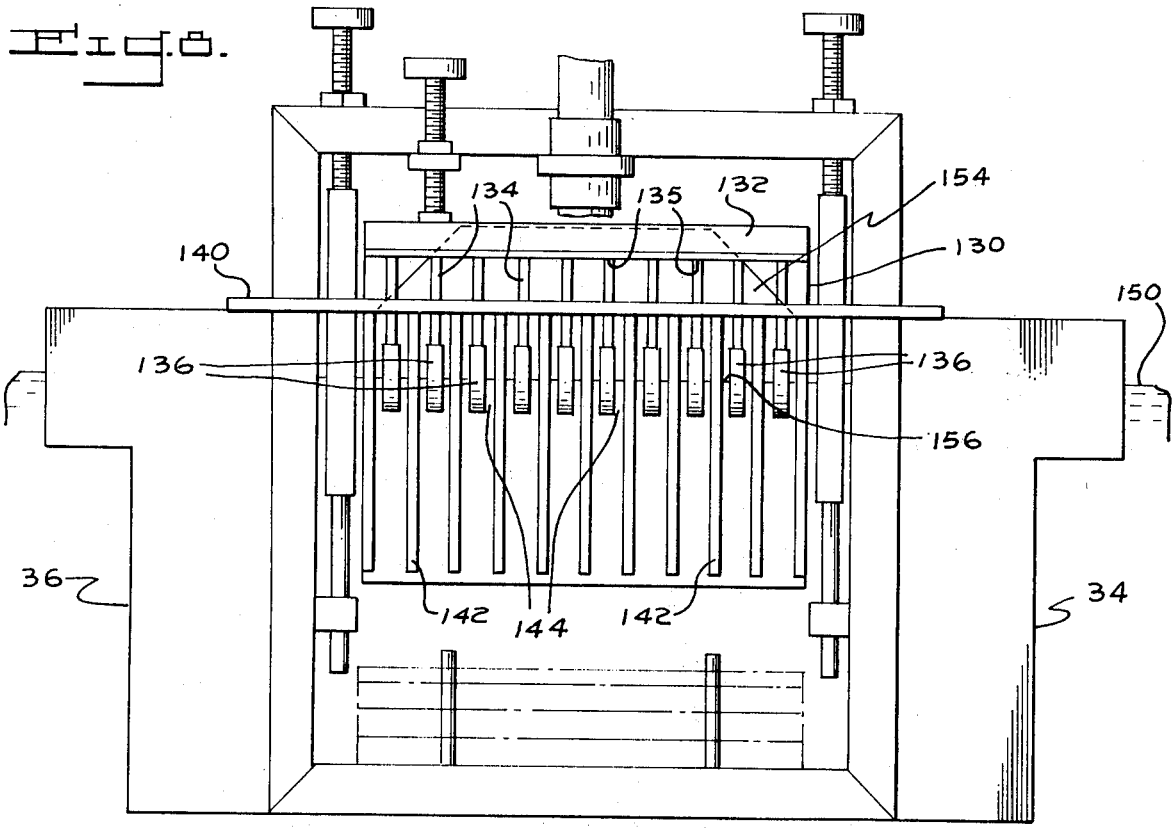

FIGS. 7 and 8 depict a tiltable skimming system, preferably of the type just described, which is provided with a self-cleaning attachment responsive to the motion of the skimmer for keeping the region just before skimmer inlet opening 154 free of debris 152. Such debris in the form of brush and miscellaneous other floating objects usually found in systems of this type can undersirably clog the skimmer interior, discharge pump and associated transfer lines which could eventually completely terminate any further skimming operation. Elements in FIGS. 7 and 8 identical to those previously described are identified with the same numbers.

The illustrated cleaning assembly comprises a plurality of substantially upright rod-like baffles 142 laterally spaced from each other and supported vertically in grid-like form between floats 34, 36 from float bracket 140 creating with the inner opposing sides of floats 34, 36 a region protectible from debris entry. Baffle spacing should be such as to prevent the smallest anticipated floating debris from passing therethrough. Plural cleaning members comprising fingers 134 secured at their inner ends 135 to bracket 132 fixed to skimmer bonnet 130 are cantilevered out over skimmer opening 154 and protrude forwardly into spaces 144 between baffles 142 generally at substantially right angles to the latter. Circular disks 136 are fixed on fingers 134 where interposed between baffles 142.

In operation of the system of FIGS. 7 and 8, the tilting rocking motion of the skimmer imparts similar motion in the up and down direction of arrowed line 138 to fingers 134 and more particularly between upper and lower limits of disks 136 depicted in phantom at 146 and 148 respectively about liquid level 150. Such frequent rocking movement of disks 138 settable by regulating the drawoff rate from the skimmer, in response to the skimmer movement rollingly displaces debris 152 trapped on the upstream side of baffles 142 away from such baffles to facilitate entry of a floating oil layer to the skimmer over lip 156 without debris interference.

In this respect the rounded contour of the disks is preferred for pushing the debris away, more pointed shapes undesirably tending to impale the debris directly thereon.

Thus, with the system of FIGS. 7 and 8 the motive power for actuating the cleaning assembly (as well as tilting the skimmer) is self-contained and hydraulically created by the rate of removal of liquid from the skimmer compartment. In other words, the rocking motion of the skimmer actuates the self-operable cleaning assembly for protectively keeping floating debris out of the region just before the skimmer inlet and avoiding otherwise undersirable downtime from plugups.

The preceeding description and particularly the drawings are set forth for purposes of illustration only and are not to be taken in a limited sense. Various modifications and alterations will be readily suggested to persons skilled in the art. For example, if desired, the liquid removed from the skimmer 12 may be discharged directly to waste instead of attempting to reclaim via a scavage reservoir. The belt skimmer in the scavage reservoir may be eliminated and discharge from the latter could be directly to waste or any other means. The cleaning system for the skimmer inlet opening though preferred for use with the hydraulically balanced/imbalanced system previously described may be used with any type of tiltable skimmer whether self-adjustably operable or manually via fluid actuators, linkages or the like. The skimmer discharge pump may be of any design but preferably is chosen to pass solids without plugging. Similarly, the conduit from the skimmer to the discharge pump and any other process lines as well as control devices should preferably be as free of internal obstructions as functionally feasible and of non-plugging design. It is intended, therefore, that the foregoing be considered as exemplary only and that the scope of the invention be ascertained from the following claims.

What is claimed is:

1. In a skimming system for removing a floating layer from a body of liquid which includes:

a skimmer for semi-immersion in said liquid having an inlet opening and a hollow interior compartment;

means supporting said skimmer for tilting movement from a recumbent position generally parallel with the liquid surface to an inclined position admitting the floating layer to the compartment; and means associated with the skimmer for removing contaminated liquid from the compartment;

the improvement comprising:

laterally spaced baffles opposite the inlet mounted on the means supporting the skimmer for blocking debris from entering the opening; and plural cleaning members protruding forwardly between the baffles mounted on the skimmer, for vertical movement with respect to the baffle;

whereby on tilting movement of the skimmer the members push away debris trapped by the baffles to facilitate movement of the floating layer to the inlet opening.

2. The system of claim 1 wherein the said members have disks thereon where protruding between the baffles.

3. The system of claim 1 wherein the cross section of an operating section of the compartment receiving liquid through the opening comprises a substantially quadrantal section intercommunicating with a substantially right triangular section.

4. The system of claim 3 wherein the skimmer is journally mounted for movement about a horizontal axis, said journal mounting lying in a plane through the compartment in the region of the confluence of the triangular and circular sections.

5. The system of claim 3 wherein the cross sectional areas of the quadrantal and triangular sections are substantially equal.

6. A liquid skimmer comprising a housing forming an inner operating compartment having a cross section circumscribing a substantially quadrantal section intercommunicating with a substantially right triangular section, said skimmer having an inlet opening, means having plural rod-like baffles thereon opposite the opening mounting the skimmer for self-adjustable tilting response to a liquid level therein, and plural cleaning fingers mounted on the housing cantilevered out over the opening between the baffles for vertical movement with respect to the baffles on tilting movement of the housing.

7. In combination with a settling reservoir, an improved decanting system comprising:

(a) a self-adjusting skimmer semi-immersed in said reservoir having an inlet opening and an irregularly shaped, hollow interior compartment comprising intercommunicating circular and triangular sections receiving a floating layer from the settling reservoir;

(b) means journally supporting said skimmer for tilting movement about a horizontal axis from a recumbent position generally parallel with the reservoir surface to an inclined position at which said opening is below the reservoir surface;

(c) means supplying contaminated liquid to the reservoir;

(d) pump means associated with the skimmer removing liquid contaminant from the hollow interior compartment of the skimmer;

(e) float means buoyantly supporting the skimmer in the settling reservoir; and (f) a cleaning assembly in the region just before the inlet opening comprising;

(i) substantially upright baffles laterally spaced from each other opposite the inlet opening mounted on the float means; and (ii) plural cleaning fingers extending away from the skimmer between the baffles mounted on the skimmer for vertical movement with respect to the baffle.

8. The combination of claim 7 wherein the fingers have disks thereon where interposed between the baffles.

9. The combination of claim 7 wherein the float means comprises dual floats in either side of the skimmer and the baffles are supported vertically in the space between the floats.

10. The combination of claim 7 wherein the skimmer is devoid of buoyant members therein.

* * * * *